US011798383B2

(12) United States Patent
Farnes et al.

(10) Patent No.: US 11,798,383 B2
(45) Date of Patent: Oct. 24, 2023

(54) INTEGRATED FENESTRATION STATUS MONITORING SYSTEMS AND METHODS FOR THE SAME

(71) Applicant: Marvin Lumber and Cedar Company, Warroad, MN (US)

(72) Inventors: Brian M. Farnes, Warroad, MN (US); Justin Magnusen, Roosevelt, MN (US)

(73) Assignee: Marvin Lomber and Cedar Company, Warroad, MN (US)

( * ) Notice: Subject to any disclaimer, the term of this patent is extended or adjusted under 35 U.S.C. 154(b) by 0 days.

(21) Appl. No.: 17/167,815

(22) Filed: Feb. 4, 2021

(65) Prior Publication Data

US 2021/0304572 A1 Sep. 30, 2021

Related U.S. Application Data

(63) Continuation of application No. 16/035,341, filed on Jul. 13, 2018, now Pat. No. 10,930,124.

(60) Provisional application No. 62/532,208, filed on Jul. 13, 2017.

(51) Int. Cl.

| | |
|---|---|
| ***G08B 13/08*** | (2006.01) |
| ***G08B 29/04*** | (2006.01) |
| ***G08B 25/00*** | (2006.01) |

(52) U.S. Cl.

CPC ..... *G08B 13/08* (2013.01); *G08B 25/008* (2013.01); *G08B 29/046* (2013.01)

(58) Field of Classification Search

CPC ..... G08B 13/08; G08B 25/008; G08B 29/046
See application file for complete search history.

(56) References Cited

U.S. PATENT DOCUMENTS

| | | | |
|---|---|---|---|
| 398,039 | A | 2/1889 | Flatman et al. |
| 660,438 | A | 10/1900 | Holly et al. |
| 937,348 | A | 10/1909 | Wheelock |

(Continued)

FOREIGN PATENT DOCUMENTS

| | | | |
|---|---|---|---|
| GB | 2333555 | A | 7/1999 |
| WO | WO-2006116675 | A2 | 11/2006 |

OTHER PUBLICATIONS

US 9,523,223 B2, 12/2016, DeBoer et al. (withdrawn)

(Continued)

*Primary Examiner* — James J Yang
(74) *Attorney, Agent, or Firm* — Schwegman Lundberg & Woessner, P.A.

(57) ABSTRACT

A fenestration assembly includes a fenestration frame and at least one panel rotatably coupled with the fenestration frame. A locking mechanism is coupled with the fenestration frame and the panel, and includes at least one latch and at least one latch fastener. In a secure configuration the panel is in a closed position and the latch is coupled with the latch fastener. In an unsecure configuration the panel is in an open position or the latch is decoupled from the latch fastener. A status monitoring assembly is configured to monitor the secure and unsecure configurations, and includes a sensor operator coupled with one of the fenestration frame or the panel, and a sensor coupled with the other of the panel or the fenestration frame. The sensor is configured to detect the sensor operator if the panel is in the closed position and the latch is coupled with the latch fastener.

26 Claims, 8 Drawing Sheets

(56) References Cited

U.S. PATENT DOCUMENTS 1,434,371 A 11/1922 Crompton et al.
2,104,134 A 1/1938 Ferdinand
2,274,711 A 3/1942 Krause
2,545,645 A 3/1951 Blakely
2,778,326 A 1/1957 Guzik
2,883,225 A 4/1959 Akehurst
2,967,595 A 1/1961 Abe
3,525,830 A 8/1970 Hawkins
3,641,540 A 2/1972 Cutler et al.
4,346,372 A 8/1982 Sandberg
4,351,288 A 9/1982 Gasloli
4,465,997 A 8/1984 Hines
4,497,135 A 2/1985 Vetter
4,624,073 A 11/1986 Randall
4,639,021 A 1/1987 Hope
4,656,463 A * 4/1987 Anders ..... G01S 13/78 340/541
5,004,961 A 4/1991 Berner et al.
5,006,766 A 4/1991 Yuhas et al.
5,090,750 A 2/1992 Lindqvist
5,226,256 A 7/1993 Fries et al.
5,301,989 A 4/1994 Dallmann et al.
5,311,168 A 5/1994 Pease, Jr. et al.
5,355,059 A 10/1994 McMillan
5,382,060 A 1/1995 O'Toole et al.
5,398,447 A 3/1995 Morse
5,437,173 A 8/1995 Spinar
5,449,987 A 9/1995 McMillan
5,592,781 A 1/1997 Mauro
5,595,075 A 1/1997 Chen
5,595,409 A 1/1997 Fier et al.
5,653,485 A 8/1997 Campbell
5,712,621 A 1/1998 Andersen
5,791,700 A 8/1998 Biro
5,992,907 A 11/1999 Sheldon et al.
6,141,913 A 11/2000 Wong et al.
6,176,041 B1 1/2001 Roberts
6,212,923 B1 4/2001 Clark
6,588,150 B1 7/2003 Wong et al.
6,615,629 B2 9/2003 Bates
6,669,242 B2 12/2003 Fountaine et al.
6,672,009 B1 1/2004 Wong et al.
6,778,086 B2 8/2004 Morrone et al.
6,817,142 B2 11/2004 Marshik et al.
6,871,885 B2 3/2005 Goldenberg et al.
6,877,784 B2 4/2005 Kelley et al.
6,938,373 B2 9/2005 Wong et al.
6,957,513 B2 10/2005 Pettit et al.
7,013,603 B2 3/2006 Eenigenburg et al.
7,042,353 B2 5/2006 Stilp
7,068,162 B2 6/2006 Maple et al.
7,070,215 B2 7/2006 Kelley et al.
7,079,020 B2 7/2006 Stilp
7,118,142 B2 10/2006 Xu
7,158,029 B1 1/2007 Martyn
7,165,791 B2 1/2007 Rebel et al.
7,227,463 B2 6/2007 Merrell
7,322,619 B2 1/2008 Nolte et al.
7,355,515 B2 4/2008 Lee et al.
7,407,199 B2 8/2008 Richardson
7,412,800 B2 8/2008 Maier
7,481,470 B2 1/2009 Eenigenburg et al.
7,591,494 B2 9/2009 Mitchell
7,607,262 B2 10/2009 Pettit et al.
7,731,251 B2 6/2010 Ye
7,812,800 B2 10/2010 Peng et al.
7,874,598 B2 1/2011 Chung
7,963,577 B2 6/2011 Wolf
7,976,077 B2 7/2011 Flory et al.
8,020,904 B2 9/2011 Flory et al.
8,182,001 B2 5/2012 Tremble et al.
8,205,920 B2 6/2012 Flory
8,269,627 B2 9/2012 Gore et al.
8,624,736 B2 1/2014 Gore et al.
8,955,255 B2 2/2015 DeBoer et al.
8,978,304 B2 3/2015 Hollermann et al.
9,157,902 B2 10/2015 Gore et al.
9,562,378 B2 2/2017 DeBoer et al.
9,657,503 B2 5/2017 Hollermann et al.
10,138,658 B2 11/2018 Barton et al.
10,228,266 B1 * 3/2019 McGruder ..... E05B 17/10
10,930,124 B2 2/2021 Fames et al.
11,015,368 B2 5/2021 Deboer et al.
11,365,561 B2 6/2022 Hollermann et al.
2002/0116874 A1 8/2002 Marshik
2003/0084614 A1 5/2003 Pettit et al.
2003/0110698 A1 6/2003 Polowinczak et al.
2003/0110699 A1 6/2003 Eenigenburg et al.
2004/0003541 A1 1/2004 Wong et al.
2004/0168370 A1 9/2004 Pettit et al.
2004/0195843 A1 10/2004 Rotondi et al.
2004/0260150 A1 10/2004 Kelley et al.
2005/0097823 A1 5/2005 Marshik
2005/0140150 A1 6/2005 Hall et al.
2006/0033343 A1 2/2006 Xu
2006/0225354 A1 10/2006 Kelley et al.
2006/0244270 A1 11/2006 Rotondi
2007/0046036 A1 3/2007 Kinsey
2007/0194914 A1 8/2007 Gates
2007/0209281 A1 9/2007 Flory et al.
2007/0262848 A1 11/2007 Berstis et al.
2008/0000162 A1 * 1/2008 Zayac ..... E05B 17/2084 49/394
2008/0084299 A1 4/2008 Fisher et al.
2008/0129054 A1 6/2008 Tremble et al.
2008/0163551 A1 7/2008 Nolte et al.
2008/0211238 A1 9/2008 Stevens
2008/0246287 A1 10/2008 Satram et al.
2009/0241429 A1 10/2009 Polowinczak et al.
2010/0050528 A1 3/2010 Pettit et al.
2010/0207403 A1 8/2010 Bourgoin et al.
2010/0218425 A1 9/2010 Nolte et al.
2010/0263415 A1 10/2010 Ruspil
2011/0113695 A1 5/2011 Derham
2011/0192089 A1 8/2011 Barton et al.
2011/0296880 A1 12/2011 Sieglaar et al.
2011/0304163 A1 12/2011 Liang et al.
2012/0313386 A1 12/2012 Liang
2012/0313387 A1 12/2012 Liang
2013/0214545 A1 8/2013 Wolf et al.
2013/0283694 A1 10/2013 Deboer et al.
2013/0283695 A1 10/2013 Hollermann et al.
2013/0285391 A1 10/2013 Wolf et al.
2014/0230331 A1 8/2014 Kellum, III
2015/0167377 A1 6/2015 Deboer et al.
2015/0184434 A1 7/2015 Hollermann et al.
2015/0252596 A1 9/2015 Liang et al.
2017/0234033 A1 8/2017 Deboer et al.
2018/0202198 A1 7/2018 Hollermann et al.
2019/0019382 A1 1/2019 Farnes et al.

OTHER PUBLICATIONS

US 10,975,597 B2, 04/2021, DeBoer et al. (withdrawn)
"U.S. Appl. No. 13/872,842, Examiner Interview Summary dated Aug. 15, 2014", 3 pgs.
"U.S. Appl. No. 13/872,842, Non Final Office Action dated Apr. 11, 2014", 16 pgs.
"U.S. Appl. No. 13/872,842, Notice of Allowance dated Sep. 29, 2014", 10 pgs.
"U.S. Appl. No. 13/872,842, Response filed Mar. 6, 2014 to Restriction Requirement dated Jan. 6, 2014", 13 pgs.
"U.S. Appl. No. 13/872,842, Response filed Sep. 3, 2014 to Non-Final Office Action dated Apr. 11, 2014", 24 pgs.
"U.S. Appl. No. 13/872,842, Restriction Requirement dated Jan. 6, 2014", 9 pgs.
"U.S. Appl. No. 13/872,864, Amendment and Response filed Aug. 22, 2014 to Final Office Action dated May 23, 2014", 14 pgs.
"U.S. Appl. No. 13/872,864, Corrected Notice of Allowance dated Dec. 1, 2014", 2 pgs.
"U.S. Appl. No. 13/872,864, Non Final Office Action dated May 23, 2014", 14 pgs.

(56) References Cited

OTHER PUBLICATIONS

"U.S. Appl. No. 13/872,864, Notice of Allowance dated Nov. 10, 2014", 10 pgs.
"U.S. Appl. No. 13/872,864, Response filed Mar. 26, 2014 to Restriction Requirement dated Feb. 3, 2014", 9 pgs.
"U.S. Appl. No. 13/872,864, Response filed Aug. 22, 2014 to Non Final Office Action dated May 23, 2014", 14 pgs.
"U.S. Appl. No. 13/872,864, Restriction Requirement dated Feb. 3, 2014", 7 pgs.
"U.S. Appl. No. 14/609,174, Applicant Interview Summary filed Apr. 12, 2016", 1 pgs.
"U.S. Appl. No. 14/609,174, Corrected Notice of Allowance dated Jan. 5, 2017", 2 pgs.
"U.S. Appl. No. 14/609,174, Non Final Office Action dated Dec. 3, 2015", 15 pgs.
"U.S. Appl. No. 14/609,174, Notice of Allowance dated May 2, 2016", 12 pgs.
"U.S. Appl. No. 14/609,174, Notice of Allowance dated Aug. 9, 2016", 8 pgs.
"U.S. Appl. No. 14/609,174, Preliminary Amendment filed Mar. 5, 2015", 8 pgs.
"U.S. Appl. No. 14/609,174, Response filed Mar. 1, 2016 to Non Final Office Action dated Dec. 3, 2015", 10 pgs.
"U.S. Appl. No. 14/609,174, Response filed Nov. 17, 2015 to Restriction Requirement dated Sep. 11, 2015", 9 pgs.
"U.S. Appl. No. 14/609,174, Restriction Requirement mailed U.S. Appl. No. 14/609,174, Restriction Requirement dated Sep. 11, 2015", 9 pgs.
"U.S. Appl. No. 14/658,834, Examiner Interview Summary dated Sep. 16, 2016", 3 pgs.
"U.S. Appl. No. 14/658,834, Final Office Action dated Nov. 25, 2016", 11 pgs.
"U.S. Appl. No. 14/658,834, Non Final Office Action dated Apr. 20, 2016", 12 pgs.
"U.S. Appl. No. 14/658,834, Notice of Allowance dated Jan. 17, 2017", 5 pgs.
"U.S. Appl. No. 14/658,834, Preliminary Amendment dated Mar. 18, 2015", 7 pgs.
"U.S. Appl. No. 14/658,834, Response filed Mar. 21, 2016 to Restriction Requirement dated Jan. 21, 2016", 9 pgs.
"U.S. Appl. No. 14/658,834, Response filed Sep. 12, 2016 to Non Final Office Action dated Apr. 20, 2016", 14 pgs.
"U.S. Appl. No. 14/658,834, Response filed Dec. 19, 2016 to Final Office Action dated Nov. 25, 2016", 9 pgs.
"U.S. Appl. No. 14/658,834, Restriction Requirement dated Jan. 21, 2016", 7 pgs.
"U.S. Appl. No. 15/430,322, Examiner Interview Summary dated Jun. 5, 2020", 3 pgs.
"U.S. Appl. No. 15/430,322, Examiner Interview Summary dated Jul. 1, 2019", 3 pgs.
"U.S. Appl. No. 15/430,322, Examiner Interview Summary dated Nov. 17, 2020", 3 pgs.
"U.S. Appl. No. 15/430,322, Final Office Action dated Aug. 11, 2020", 14 pgs.
"U.S. Appl. No. 15/430,322, Non Final Office Action dated Jan. 29, 2020", 14 pgs.
"U.S. Appl. No. 15/430,322, Non Final Office Action dated Feb. 5, 2019", 9 pgs.
"U.S. Appl. No. 15/430,322, Notice of Allowance dated Jul. 31, 2019", 5 pgs.
"U.S. Appl. No. 15/430,322, Notice of Allowance dated Nov. 20, 2020", 5 pgs.
"U.S. Appl. No. 15/430,322, Response filed May 29, 2020 to Non Final Office Action dated Jan. 29, 2020", 23 pgs.
"U.S. Appl. No. 15/430,322, Response filed Nov. 11, 2020 to Final Office Action dated Aug. 11, 2020", 17 pgs.
"U.S. Appl. No. 15/430,322, Response filed Jul. 5, 2019 to Non-Final Office Action dated Feb. 5, 2019", 16 pgs.
"U.S. Appl. No. 15/430,322, Supplemental Notice of Allowability dated Mar. 17, 2021", 2 pgs.
"U.S. Appl. No. 15/430,322, Supplemental Notice of Allowability dated Apr. 23, 2021", 2 pgs.
"U.S. Appl. No. 15/430,322, Supplemental Notice of Allowability dated Dec. 11, 2020", 2 pgs.
"U.S. Appl. No. 15/873,707, Examiner Interview Summary dated Mar. 15, 2021", 2 pgs.
"U.S. Appl. No. 15/873,707, Non Final Office Action dated Jun. 29, 2021", 21 pgs.
"U.S. Appl. No. 15/873,707, Non Final Office Action dated Nov. 23, 2020", 34 pgs.
"U.S. Appl. No. 15/873,707, Response filed Mar. 24, 2021 to Non Final Office Action dated Nov. 23, 2020", 27 pgs.
"U.S. Appl. No. 16/035,341, Examiner Interview Summary dated Sep. 30, 2020", 3 pgs.
"U.S. Appl. No. 16/035,341, Final Office Action dated Jun. 9, 2020", 19 pgs.
"U.S. Appl. No. 16/035,341, Non Final Office Action dated Oct. 15, 2019", 19 pgs.
"U.S. Appl. No. 16/035,341, Notice of Allowance dated Oct. 21, 2020", 9 pgs.
"U.S. Appl. No. 16/035,341, Response filed Mar. 16, 2020 to Non Final Office Action dated Oct. 15, 2019", 19 pgs.
"U.S. Appl. No. 16/035,341, Response filed Oct. 9, 2020 to Final Office Action dated Jun. 9, 2020", 12 pgs.
"Canadian Application Serial No. 3,001,471, Voluntary Amendment filed Nov. 3, 2020", 9 pgs.
"Canadian Application Serial No. 3,011,471, Office Action dated Dec. 9, 2020", 3 pgs.
"Definition of the word "cam"", [Online]. Retrieved from the Internet: <URL: https://www.merriam-webster.com>, (2021), 11 pgs.
"Definition of the word "translate"", [Online], Retrieved from the Internet: <URL: https://www.merriam-webster.com>, (2021), 14 pgs.
"Definition of the word "translation"", [Online], Retrieved from the Internet: <URL: https://www.merriarn-webster.com>, (2021), 13 pgs.
"European Application Serial No. 11154029.0, European Search Report and Opinion dated Sep. 25, 2012", 7 pgs.
"Kolbe & Kolbe Windows & Doors", [online] [retrieved Apr. 23, 2012], Retrieved from the Internet: <URL: http://www.kolbe-kolbe.com/>, 1 pg.
Sopkowiak, J., "Sash Limited Apparatus and Method", U.S. Appl. No. 13/328,776, filed Dec. 16, 2011, 67 pgs.
Sopkowiak, J., "Sash Limiter Apparatus and Method", U.S. Appl. No. 61/486,813, filed May 17, 2011, 63 pgs.
"U.S. Appl. No. 15/873,707, Corrected Notice of Allowability dated May 20, 2022", 8 pgs.
"U.S. Appl. No. 15/873,707, Notice of Allowance dated Jan. 20, 2022", 10 pages.
"U.S. Appl. No. 15/873,707, Response filed Sep. 29, 2021 to Non Final Office Action dated Jun. 29, 2021", 17 pgs.
"Canadian Application Serial No. 2,957,874, Examiner's Rule 86(2) Requisition dated Sep. 29, 2022", 3 pgs.
"Canadian Application Serial No. 2,957,874, Office Action dated Dec. 15, 2021", 3 pgs.
"Canadian Application Serial No. 2,957,874, Response filed Apr. 14, 2022 to Office Action dated Dec. 15, 2021", 115 pgs.
"Canadian Application Serial No. 2,95/,874, Response Filed Oct. 4, 2022 to Examiner's Rule 86(2) Requisition dated Sep. 29, 2022", 11 pgs.
"Canadian Application Serial No. 2,992,217, Office Action dated Dec. 8, 2021", 4 pgs.
"Canadian Application Serial No. 2,992,217, Response Filed Apr. 6, 2022 to Office Action dated Dec. 8, 2021", 14 pgs.
"Definition for "transverse,"", <https://www.merriam-webster.com/dictionary/transverse>, (2022), 12 pages.
"Canadian Application Serial No. 2,957,874, Examiners Rule 86(2) Report dated Aug. 25, 2023", 3 pgs.

* cited by examiner

INTEGRATED FENESTRATION STATUS MONITORING SYSTEMS AND METHODS FOR THE SAME

CLAIM OF PRIORITY

This patent application is a continuation of Fames et. al., U.S. patent application Ser. No. 16/035,341 entitled "INTEGRATED FENESTRATION STATUS MONITORING SYSTEMS AND METHODS FOR THE SAME," filed on Jul. 13, 2018 (Attorney Docket No. 1261.173US1), which claims the benefit of priority of Fames et. al., U.S. Provisional Patent Application Ser. No. 62/532,208 entitled "INTEGRATED FENESTRATION STATUS MONITORING SYSTEMS AND METHODS FOR THE SAME," filed on Jul. 13, 2017 (Attorney Docket No. 1261.173PRV), which are hereby incorporated by reference herein in their entireties.

CROSS-REFERENCE TO RELATED PATENT DOCUMENTS

This patent application is also related to U.S. patent application Ser. No. 15/430,322 entitled, "INTEGRATED FENESTRATION STATUS MONITORING SYSTEM AND METHODS FOR THE SAME," filed Feb. 10, 2017.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below, and in the drawings, that form a part of this document: Copyright Marvin Lumber and Cedar Company d/b/a Marvin Windows and Doors, Warroad, MN. All Rights Reserved.

TECHNICAL FIELD

This document pertains generally, but not by way of limitation, to status monitoring of fenestration assemblies including windows and doors.

BACKGROUND

Fenestration assemblies including door assemblies, window assemblies, and the like have one or more movable panels such as sashes or doors. The panels are movable relative to respective window and door frames. Security features are provided to fenestration assemblies to facilitate closing and locking of the assemblies to accordingly secure a home, building or the like.

Confirmation of closing and locking of a fenestration assembly is accomplished in some examples with a plurality of sensors. Each sensor is configured to detect a status of the fenestration assembly. For instance, in one example, a sensor is provided to detect whether the door or sash of the fenestration assembly is closed. Another sensor (second sensor) is provided to detect if the door or sash is locked. The status of each sensor including detection of a closed condition by the first sensor and a locked condition by the second sensor is, for example, provided to a user remotely to indicate both status conditions of the assembly. That is to say open/closed and locked/unlocked status indicators for the fenestration assembly are provided to a user.

In another example, the output of the sensors including open/closed conditions from a first sensor and locked/unlocked conditions from a second sensor are interpreted by a controller (e.g., processor, memory, program or the like) to determine if the fenestration assembly is secure or unsecure. The controller provides a secure status if both the closed and locked conditions occur at the same time. However, if the first sensor detects the open condition and the second sensor detects either of the locked or unlocked conditions, the controller provides an unsecure status. Similarly, if the second sensor detects the unlocked condition and the first sensor detects either of the open or closed conditions the controller provides an unsecure status. Stated another way, the controller is provided with an algorithm that in effect provides a flow chart to determine the secure or unsecure status of the fenestration assembly based.

Overview

The present inventors have recognized, among other things, that a problem to be solved includes reducing the number of sensors and supporting components needed to determine if a fenestration assembly is secure (closed and locked) or unsecure. In some examples, status monitoring systems use a plurality of sensors. Each of the sensors is configured to detect a separate condition of the assembly. For instance, a first sensor detects the locked/unlocked condition and a second sensor detects the closed/open condition. Spacing for the sensors is provided in or on the fenestration assembly. Where the sensors are provided in the fenestration assembly routing, molding or the like is used to provide sufficient space for the sensors. Where the sensors are provided on the fenestration assembly the aesthetic appeal of the assembly is decreased because of the visible installed sensors. Further, where a controller is used to interpret the conditions from the various sensors and output one or more status indicators for the fenestration assembly, additional space is allocated within the fenestration assembly for the controller, or optionally, the controller is fastened to the exterior of the fenestration assembly (thereby further decreasing the aesthetic appeal). Further still, the controller provides additional expense and labor for the status monitoring assembly because of additional electronics, coding (for algorithms) or the like.

The present subject matter provides a solution to this problem, such as by providing a status monitoring assembly including a sensor (e.g., sensor, switch or the like) configured to provide a secure status indicator with the fenestration assembly closed and locked. In one example a sensor and a sensor operator (e.g., a sensor assembly) are installed with the fenestration assembly. The sensor is configured to detect the sensor operator when the fenestration assembly is closed (e.g., the door, sash, or sashes are closed) and the locking mechanism is locked (e.g., a latch is coupled with a latch fastener). When both of these conditions are satisfied the sensor operator is detected by the sensor and a secure status for the assembly is achieved. In other permutations or conditions, where one or more of the panel is open or the locking mechanism is unlocked, the sensor fails to detect the sensor operator and accordingly the status monitoring assembly provides an unsecure status (including a failure to indicate the system is secure). Relatively complex logic (i.e., flowchart type algorithms) and associated controllers that assess multiple conditions from multiple sensors and output a status based on the assessment are thereby avoided.

The status monitoring assembly described in the examples herein thereby determines the secure and unsecure status through a consolidated system including one or more sensors (as opposed to requiring at least two sensors). Further, the status monitoring assembly performs this function without the use of a controller, algorithms, subscription to a service that broadcasts (and optionally interprets) status data from the fenestration assembly or the like. Instead, the secure or unsecure status of the status monitoring assembly is in one example readily broadcast with a wireless transceiver (including a transmitter) and received at an output device at the home or with the user (e.g., a smartphone, tablet or the like).

Because the status monitoring assemblies described herein use a sensor and sensor operator and do not require multiple sensors, the integration of the assemblies with fenestration components (e.g., frames, doors, sashes or the like) is facilitated relative to the multiple components of other status monitoring systems having plural sensors, a controller and the like. Accordingly, routing of recesses and routing of interconnections for power and transmission (where included) are thereby reduced, and the status monitoring assemblies (including a sensor assembly, power source, transceiver or the like) are readily integrated with fenestration assemblies. Further, because of the minimal number of components, the status monitoring assembly is readily concealed within fenestration assemblies to maintain the aesthetic appeal of the assembly.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
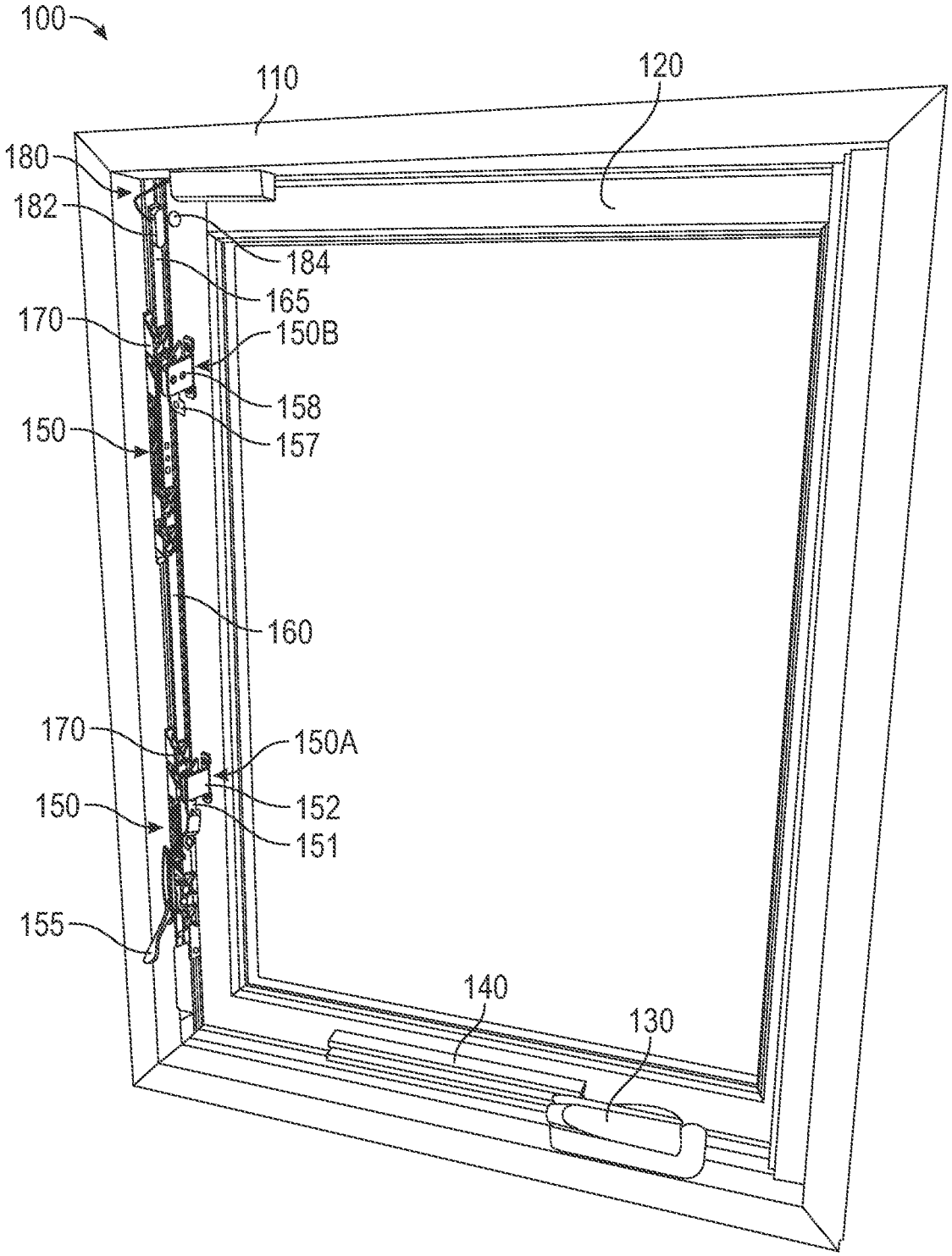
FIG. 1 is a perspective view of one example of a fenestration assembly.

FIG. 1 is a perspective view of one example of a fenestration assembly 100 (e.g., a window assembly, door assembly, or the like). The fenestration assembly 100 incudes a fenestration frame 110 and a panel 120 (e.g., a door, a sash, or the like). The fenestration frame 110 is configured to be coupled to structures, including (but not limited to) a shed, a barn, a single-family residence, a multi-family residence, a municipal building, an office building, a warehouse, or the like. In an example, a casement window is coupled to a wall of a residence. The panel 120 optionally includes a pane of glass, and in some examples, the panel 120 is rotatable relative to the fenestration frame 110 (e.g., the panel 120 may rotate between an open position and a closed position). In another example, the panel 120 is configured to slide relative to the fenestration frame 110.

In the example shown in FIG. 1, the fenestration assembly 100 includes a panel operator 130 (e.g., a crank, a lever, a handle, a latch, or the like) configured to open and close the panel 120. In some examples, the panel operator 130 is engaged with an operator linkage 140. The operator linkage 140 is coupled between the panel 120 and the fenestration frame 110 and facilitates the opening of the panel 120 (e.g., rotation, sliding or the like) relative to the fenestration frame 110. For example, the panel operator 130 is moved (e.g., manipulated or rotated) by a user, automated drive mechanism or the like and the panel operator 130 engages with the operator linkage 130 to open or close the fenestration assembly 100.

Further, and in some examples, the fenestration assembly 100 includes one or more locking mechanisms. In the example shown in FIG. 1, the fenestration assembly 100 includes a first locking mechanism 150A or a second locking mechanism 150B (collectively referred to as "locking mechanisms 150"). The locking mechanism 150 includes locked and unlocked configurations. In the locked configuration, the panel 120 is fixed relative to the fenestration frame 110 (e.g., the panel 120 is held in place while closed and unable to rotate relative to the fenestration frame 110). In the unlocked configuration, the panel 120 is not fixed relative to the fenestration frame 110 (e.g., the panel 120 is able to rotate, or translate, relative to the fenestration frame 110, for instance with operation of the panel operator 130).

Figure 2:
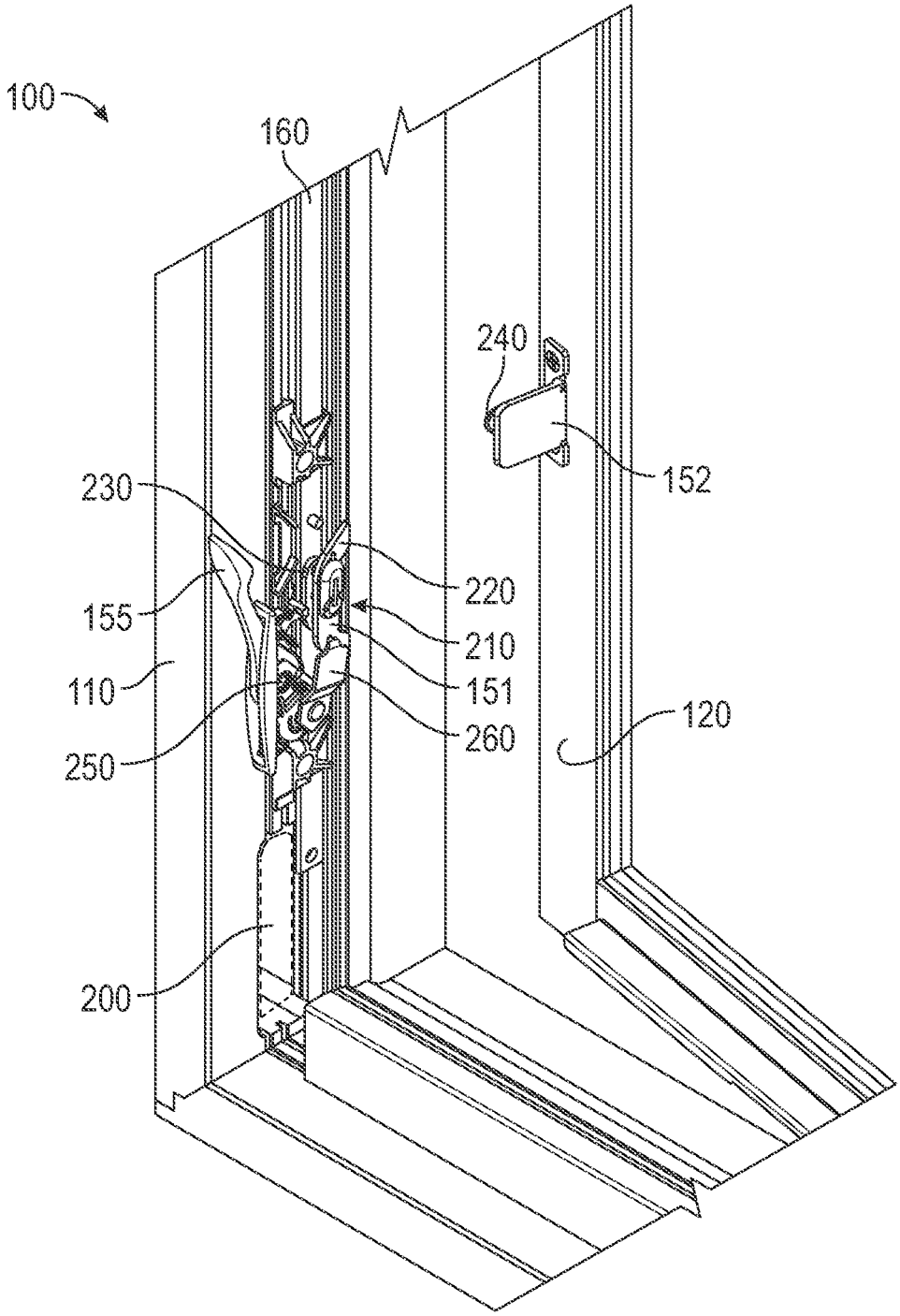
FIG. 2 is a detailed perspective view showing the fenestration assembly of FIG. 1 with the panel in an open position.

FIG. 2 is a detailed perspective view showing the fenestration assembly 100 of FIG. 1 with the panel 120 in an open position (the panel 120 is positioned in proximity to the frame 110 for illustration). As shown, the locking mechanism 150 includes a first latch 151 and a first latch fastener 152. When closed and locked, the first latch 151 selectively couples (e.g., engages) with the first latch fastener 152 to fix the panel 120 relative to the fenestration frame 110. For example, the first latch fastener 152 is coupled with the panel 120, and the first latch 151 is coupled with the fenestration frame 110. In the locked configuration, the first latch 151 is coupled with the first latch fastener 152, and the coupling (e.g., engagement) of the first latch 151 with the first latch fastener 152 prevents the movement (e.g., rotation, sliding) of the panel 120 relative to the fenestration frame 110. In the unlocked configuration, the first latch 151 is disengaged from the first latch fastener 152, and the panel 120 is free to move relative to the fenestration frame 110 (e.g., from closed to open, toward an open position wider than that shown in FIG. 2 or the like).

The locking mechanism 150 optionally includes a locking operator 155 (e.g., a lever, slider, handle, or the like). In an example, the locking operator 155 is coupled with the first latch 151, and movement (e.g., translation or manipulation) of the locking operator 155 couples or decouples the first latch 151 with the first latch fastener 152 to lock or unlock the locking mechanism 150. For example, the locking operator 155 is rotatably coupled to a pivot point 250. Additionally, in this example, the locking operator 155 is coupled to a latch linkage 260. The locking operator 155 is configured to move (e.g., rotate about the pivot point 250) and the movement of the locking operator 155 is transferred to the first latch 151 by the latch linkage 260. In some examples, the first latch 151 is coupled to a tie bar 160, and translation of the locking operator 155 is optionally transferred to the tie bar 160 by the latch linkage 260 and the first latch 151. In still other examples, the locking operator 155 is directly coupled with the tie bar 160, for instance with a pin and groove assembly, and the tie bar 160 is coupled with the first latch 151 (and in some examples additional latches elsewhere on the fenestration assembly).

Referring again to FIG. 2, the locking mechanism 150 (e.g., the first latch 151 or the second latch 152) optionally includes a latch blade 210. In an example, the latch blade 210 includes a tapered portion 220 and includes a locking portion 230. In some examples, the tapered portion 220 of the latch blade 210 is configured to bias a latch fastener (e.g., the first latch fastener 152) toward the locking portion 230 of the latch blade 210. For example, the first latch fastener 152 optionally includes a pin 240, and the tapered portion 220 biases the pin 240 of the first latch fastener 152 toward the locking portion 230 of the latch blade 210. Accordingly, the latch blade 210 facilitates the transition of the locking mechanism 150 into the locking configuration, for example by allowing the latch 151 to couple with the latch fastener 152 if the panel 120 is in a partially open position with the panel 120 in proximity to the frame 110. The assistance in the transition provided by the latch blade 210, in another example, facilitates the positioning of the panel 120 from the open position to the closed position.

As shown in FIGS. 1 and 2, the locking mechanism 150 optionally includes a tie bar 160 and the tie bar 160 is coupled to the locking operator 155. The tie bar 160 is configured to translate with respect to the fenestration frame 110. Additionally, the tie bar 160 is configured to transmit the motion (e.g., rotation or translation) from the locking operator 155 to one or more of the first locking mechanism 150A or the second locking mechanism 150B. For example, the locking operator 155 is rotated, and the tie bar 160 correspondingly translates the first latch 151 (e.g., slides up or down with respect to the fenestration frame 110) to couple or decouple the first latch 151 with the first latch fastener 152. Optionally, the tie bar 160 couples a second latch 157 with a second latch fastener 158 to couple or decouple these features at the second locking mechanism 150B. In another example, the tie bar 160 interconnects the first locking mechanism 150A and the second locking mechanism 150B to simultaneously change the configurations of (e.g., lock or unlock) the first locking mechanism 150A and the second locking mechanism 150B.

The tie bar 160 optionally includes a tie bar arm 165. The tie bar arm 165 projects away from at least one of the one or more locking mechanisms 150, for instance the second locking mechanism 150B. In an example, the tie bar arm 165 projects from the second locking mechanism 150B, and the tie bar arm 165 is positioned proximate a corner of the fenestration frame 110. In another example, the tie bar arm 165 translates (e.g., reciprocates) with respect to the locking mechanism 150 when the tie bar 160 translates (e.g., if the locking operator 155 is moved by a user).

The fenestration assembly 100 optionally includes a retaining bracket 170. The retaining bracket 170 defines a channel, and the channel is sized and shaped to receive the tie bar 160. The retaining bracket 170 is coupled with the fenestration frame 110, and accordingly couples the tie bar 160 with the fenestration frame 110. The tie bar 160 is slidably coupled with the retaining bracket 160 (e.g., the channel), and the tie bar 160 is configured to translate with respect to the fenestration frame 110. In an example, the tie bar arm 165 translates (e.g., reciprocates) with respect to the retaining bracket 170 and the position of the tie bar arm 165 (e.g., an end portion of the tie bar arm 165) varies with respect to the retaining bracket 170 (or the fenestration frame 110, for instance a corner of the fenestration frame 110).

Figure 3A:
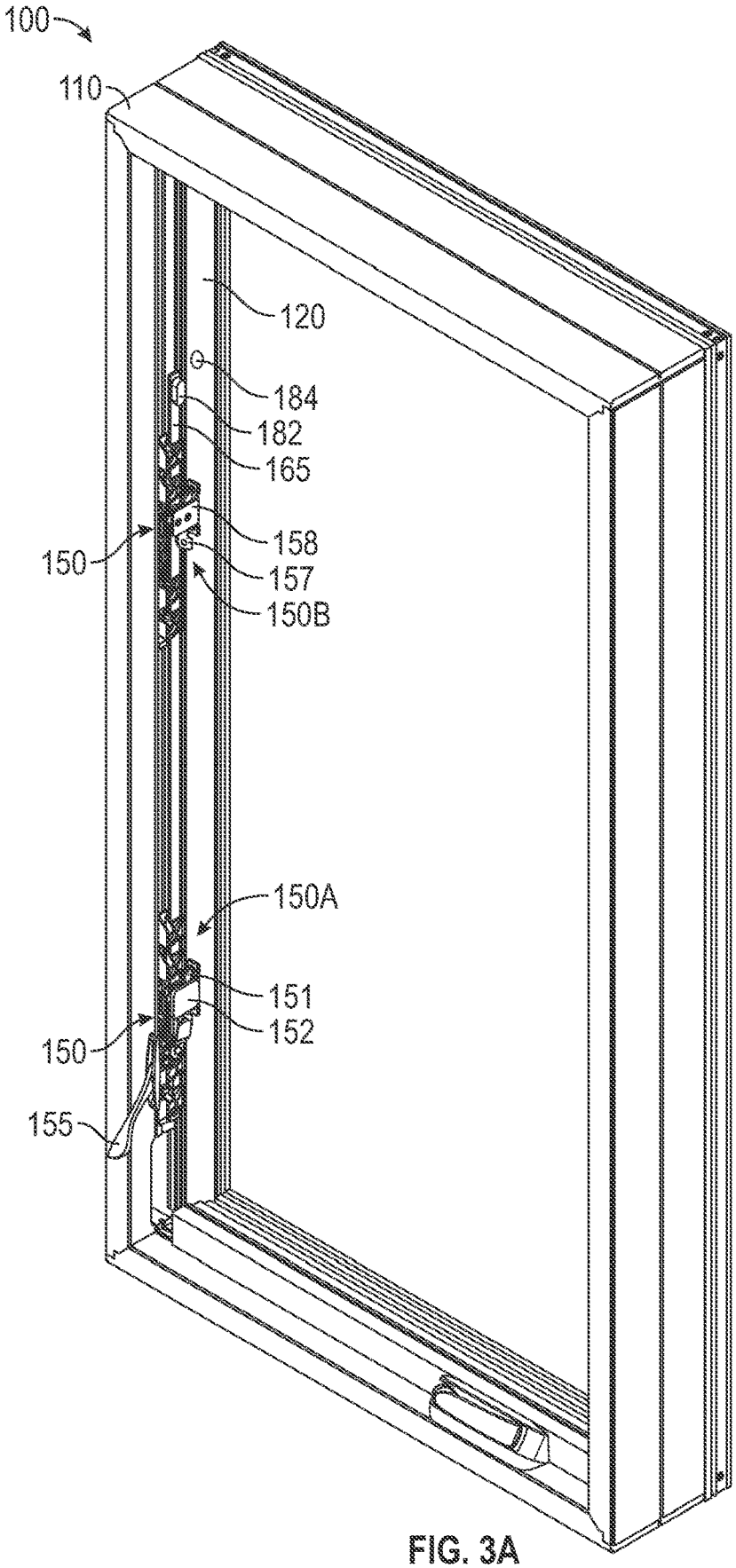
FIG. 3A is a detailed perspective view showing the fenestration assembly of FIG. 1 in a secure configuration with a panel in a closed position and a locking mechanism is in a locked configuration.

As shown in FIGS. 1 and 3A, the fenestration assembly 100 includes a status monitoring assembly 180. The status monitoring assembly 180 monitors a secure configuration (e.g., the panel 120 is in the closed position and the one or more locking mechanisms 150 are locked) and an unsecure configuration (including one or more unsecure configurations, such as the panel 120 is open or the one or more locking mechanisms 150 are unlocked) of the fenestration assembly 100. The status monitoring assembly 180 includes at least one sensor 182 and at least one sensor operator 184. In an example, the sensor 182 is coupled to one of the fenestration frame 110 or the panel 120. The sensor operator 184 is coupled to the other of the panel 120 or the fenestration frame 110. As shown in FIG. 3A, the sensor 182 is coupled to the tie bar 160 (e.g., the tie bar arm 165, or between the one or more locking mechanisms 150) and the sensor operator 184 is coupled with the panel 120. In another example, the sensor operator 182 is positioned remote relative to one or more of a latch (e.g., the second latch 157 in the example shown in FIG. 3A) or a latch fastener (e.g., the second latch fastener 158). For instance, the second latch 157 is coupled to the fenestration frame 110, the second latch fastener 158 is coupled to the panel 120, and the sensor operator 184 is coupled to the panel 120 remote relative from (e.g., spaced from) the second latch fastener 158.

The sensor 182 (e.g., a magnetic sensor, a mechanical switch, an electrical switch, or the like) detects the presence of the sensor operator 184 (e.g., a magnet, a mechanical contact, an electrical contact, or the like). In an example, the sensor 182 detects the sensor operator 184 positioned proximate the sensor operator 184. For example, the sensor 182 includes an electrical switch, and if the sensor operator 184 is positioned proximate the sensor 182 (e.g., the panel 120 is closed and locked), the electrical switch is closed and one or more of current or a change in resistance or potential are sensed. If the sensor operator 184 is remote from the sensor 182, the electrical switch is open and the sensor accordingly fails to detect the closed and locked panel 120.

The sensor 182 and the sensor operator 184 are coupled to the fenestration assembly 100 to facilitate the monitoring of the secure and unsecure configurations of the fenestration assembly 100. In an example, the sensor 182 detects the sensor operator 184 if the panel 120 is in the closed position. In another example, the sensor 182 detects the sensor operator 184 if a latch (e.g., the first latch 151) is coupled with a latch fastener (e.g., the first latch fastener 152). In still another example, the sensor 182 detects the sensor operator 184 because the fenestration assembly 100 is in the closed position and the latch is coupled with the latch fastener.

The status monitoring assembly 180 is optionally configured to report an indication (e.g., an LED is activated, a mechanical flag or indicia is triggered, an electrical or electromagnetic signal) of the secure configuration if the sensor operator 184 is detected by the sensor 182. Additionally, and in some examples, the status monitoring assembly 180 is configured to report an indication of the unsecure configuration if the sensor operator 184 is undetected by the sensor 182.

Referring again to FIG. 2, the fenestration assembly 100 optionally includes a module 200, and the module 200 provides a connection (e.g., one or more of wired or wireless connections) between the sensor 182 and one or more additional components, including (but not limited to) home networks, home servers, applications (e.g., cellular phone apps or desktop programs), computers, or the like (each included as optional components of the fenestration status monitoring assembly 180). In some examples, the module 200 includes a transceiver (e.g., one or more of a receiver or a transmitter), a power supply (e.g., a battery or transformer), a Power over Ethernet interface, a network interface (e.g., an RJ-45 port) or the like. The module 200 is optionally concealed within one or more of the fenestration frame 110 or the panel 120. Optionally, components of the module 200 (e.g., a power supply and a transceiver) are divided into two or more units, and the units are separately coupled to (including concealed within) the fenestration frame 110 or the panel 120.

FIG. 3A is a detailed perspective view showing the fenestration assembly 100 of FIG. 1 in a secure configuration with the panel 120 in the closed position and the locking mechanism 150 in the locked configuration. The example assembly 100 includes the first locking assembly 150A and the second locking assembly 150B in the locked configuration, the first latch 151 is coupled with the first latch fastener 152, and the second latch 157 is coupled with the second latch fastener 158 of the respective assemblies 150A, B. Accordingly, the panel 120 is held static in the closed position relative to the fenestration frame 110.

As described herein and shown in FIG. 3A, the sensor 182 is coupled to the tie bar arm 165 and the sensor operator 184 is coupled to the panel 120. With the window assembly 100 in the secure configuration, the sensor 182 is positioned proximate (e.g., adjacent to, close to, positioned near, or the like) the sensor operator 184, and the sensor 182 detects the presence of the sensor operator 184. Accordingly, the status monitoring assembly 180 detects that the fenestration assembly 100 is in the secure configuration. As described herein, the detected secure configuration is optionally reported (e.g., indicated). In some examples, the sensor 182 is configured to detect the sensor operator 184 only if the panel 120 is in the closed position and a latch (e.g., the second latch 157) is coupled with a latch fastener (e.g., the second latch fastener 158). In this configuration the sensor operator 184 is in proximity to the sensor 182 and thereby detected. As a result, the sensor 182 is configured to detect the sensor operator 184 only if the fenestration assembly 100 is in the secure configuration (e.g., closed and locked). With the fenestration assembly 100 either open, unlocked or open and unlocked the sensor 182 and the sensor operator 184 are not in proximity to each other (as described herein) and accordingly the status monitoring assembly 100 does not detect a secure configuration, and optionally indicates (e.g., reports) an unsecure configuration.

Figure 3B:
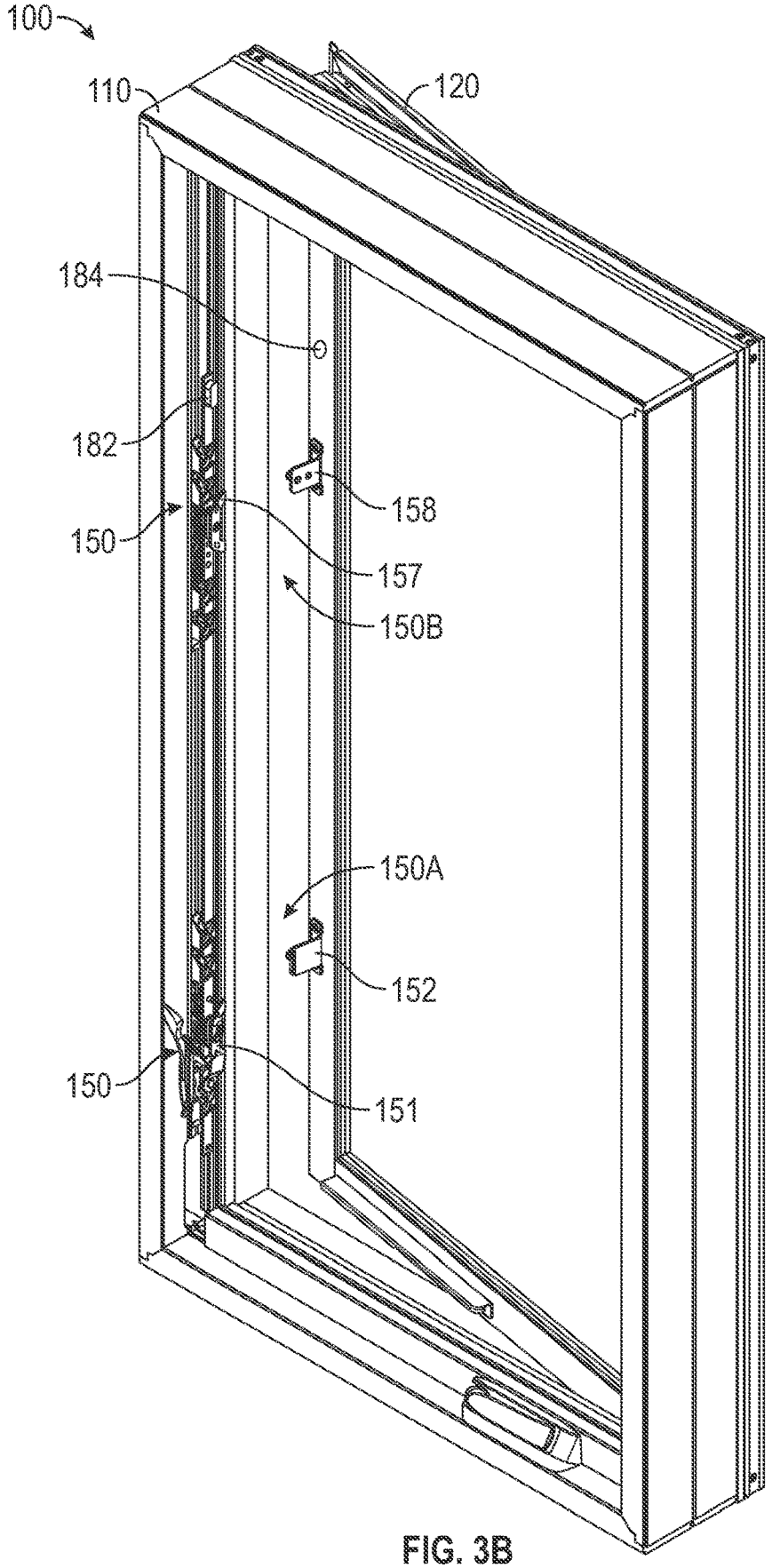
FIG. 3B is a detailed perspective view showing the fenestration assembly of FIG. 1 in a first unsecure configuration with the panel in the open position and the locking mechanism is in an unlocked configuration.

FIG. 3B is a detailed perspective view showing the fenestration assembly 100 of FIG. 1 in an example first unsecure configuration with the panel 120 in the open position and the locking mechanism 150 in the unlocked configuration. The first latch 151 is decoupled from the first latch fastener 152, and the second latch 157 is decoupled from the second latch fastener 158. The panel 120 is accordingly not locked and is free to move (e.g., able to rotate or slide between the open and closed positions).

As shown, in the first unsecure configuration the sensor operator 184 is remote relative to (e.g., not adjacent to, not close to, or positioned away from) the sensor 182. Because the panel 120 is in the open position, the sensor 182 fails to detect the sensor operator 184, and the status monitoring assembly 180 indicates the fenestration assembly 100 is in an unsecure configuration (including a failure to indicate a second configuration). In another example, the status monitoring assembly 180 reports (e.g., provides, transmits or the like) an indication of the unsecure configuration, such as a signal or failure to provide a signal (including no signal).

Figure 3C:
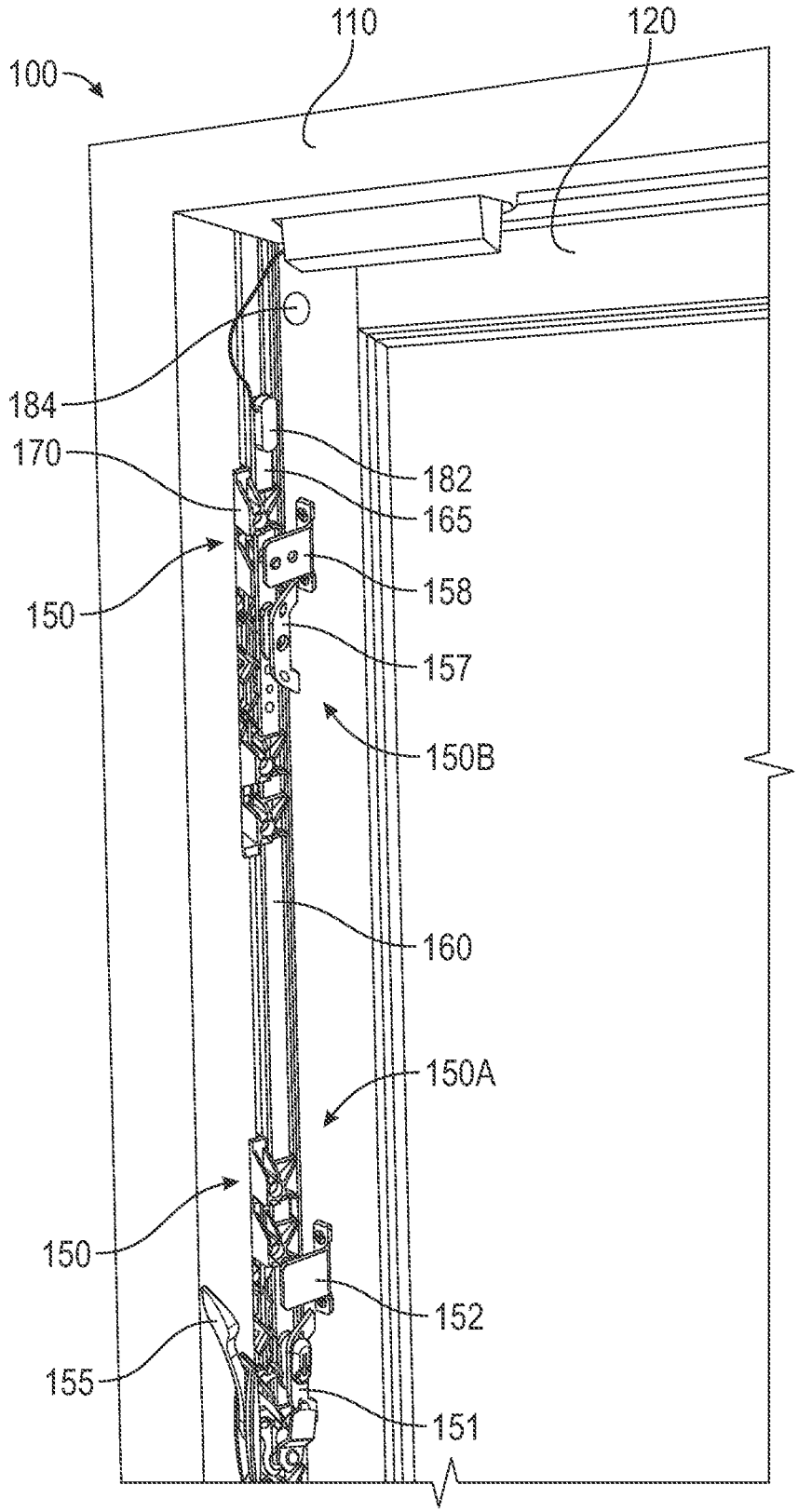
FIG. 3C is a detailed perspective view showing the fenestration assembly of FIG. 1 in a second unsecure configuration with the panel in the closed position and the locking mechanism is in the unlocked configuration.

FIG. 3C is a detailed perspective view showing the fenestration assembly 100 of FIG. 1 in a second unsecure configuration with the panel 120 in the closed position and the locking mechanism 150 is in the unlocked configuration. The first locking assembly 150A and the second locking assembly 150B are in the unlocked configuration, the first latch 151 is decoupled from the first latch fastener 152, and the second latch 157 is decoupled from the second latch fastener 158. Accordingly, the panel 120 is not fixed relative to the fenestration frame 110.

The tie bar 160 is coupled with the locking operator 155, and the tie bar 160 transmits motion (e.g., translation or movement) of the locking operator 155 to each of the one or more locking mechanisms 150 (e.g., the first locking mechanism 150A and the second locking mechanism 150B). In some examples, the tie bar arm 165 projects away from at least one of the locking mechanisms 150, and the sensor 182 (or the sensor operator 184) is coupled to the tie bar arm 166. Accordingly, the tie bar arm 165 positions the sensor 182 (or the sensor operator 184) remote relative to one or more of the locking mechanisms 150.

In some examples, the sensor 182 is repositionable relative to the fenestration frame 110 (and/or the sensor operator 184). As discussed herein, the tie bar 160 is configured to translate with respect to the fenestration frame 110 (or the retaining bracket 170). The tie bar arm 165 correspondingly translates with respect to the fenestration frame 110. The sensor 182 (or the sensor operator 184) is optionally coupled to the tie bar arm 165, and accordingly, the sensor 182 translates with respect to the fenestration frame 110 if the locking operator 155 is manipulated. The translation of the sensor 182 repositions the sensor 182 relative to the fenestration frame 110 or other components of the fenestration assembly 100 (e.g., the first latch fastener 152, the retaining bracket 170, or the sensor operator 184). For example, the sensor 182 is positioned proximate to the second latch fastener 158 if the locking mechanism 150 is in the unlocked configuration. Conversely, the sensor 182 is positioned remote to the second latch fastener 158 if the locking mechanism 150 is in the locked configuration.

In an example, if the locking mechanism 150 is in an unlocked configuration (e.g., the second unlocked configuration shown in FIG. 3C), the sensor operator 184 is positioned remote relative to the sensor 182 because the sensor 182 is positioned relatively downward (e.g., toward the retaining bracket 170) while the locking mechanism 150 is in the unlocked configuration. If the locking mechanism 150 is in the unlocked configuration, the sensor 182 does not detect the sensor operator 184. Because the sensor 182 does not detect the sensor operator 184, the status monitoring assembly 180 reports a signal (including no signal) indicating that the fenestration assembly 100 is in an unsecure configuration, including (but not limited to) the first unsecure configuration shown in FIG. 3B.

In an example, the locking operator 155 is moved (e.g., manipulated by a user) and the locking mechanism 150 is transitioned to the locked configuration. The tie bar 160 (and the tie bar arm 165) translates with respect to the fenestration frame 110 (e.g., away from the retaining bracket 170). The translation of the tie bar 160 positions the sensor operator 182 proximate relative to the sensor 182, and in the locked configuration, the sensor 182 detects the sensor operator 184. Accordingly, the sensor 182 fails to detect the sensor operator 184, and the status monitoring assembly 180 reports (e.g., provides) an indication (e.g., an electrical signal) indicating that the fenestration assembly 100 is in an unsecure configuration, including (but not limited to) the second unsecure configuration shown in FIG. 3C.

Figure 3D:
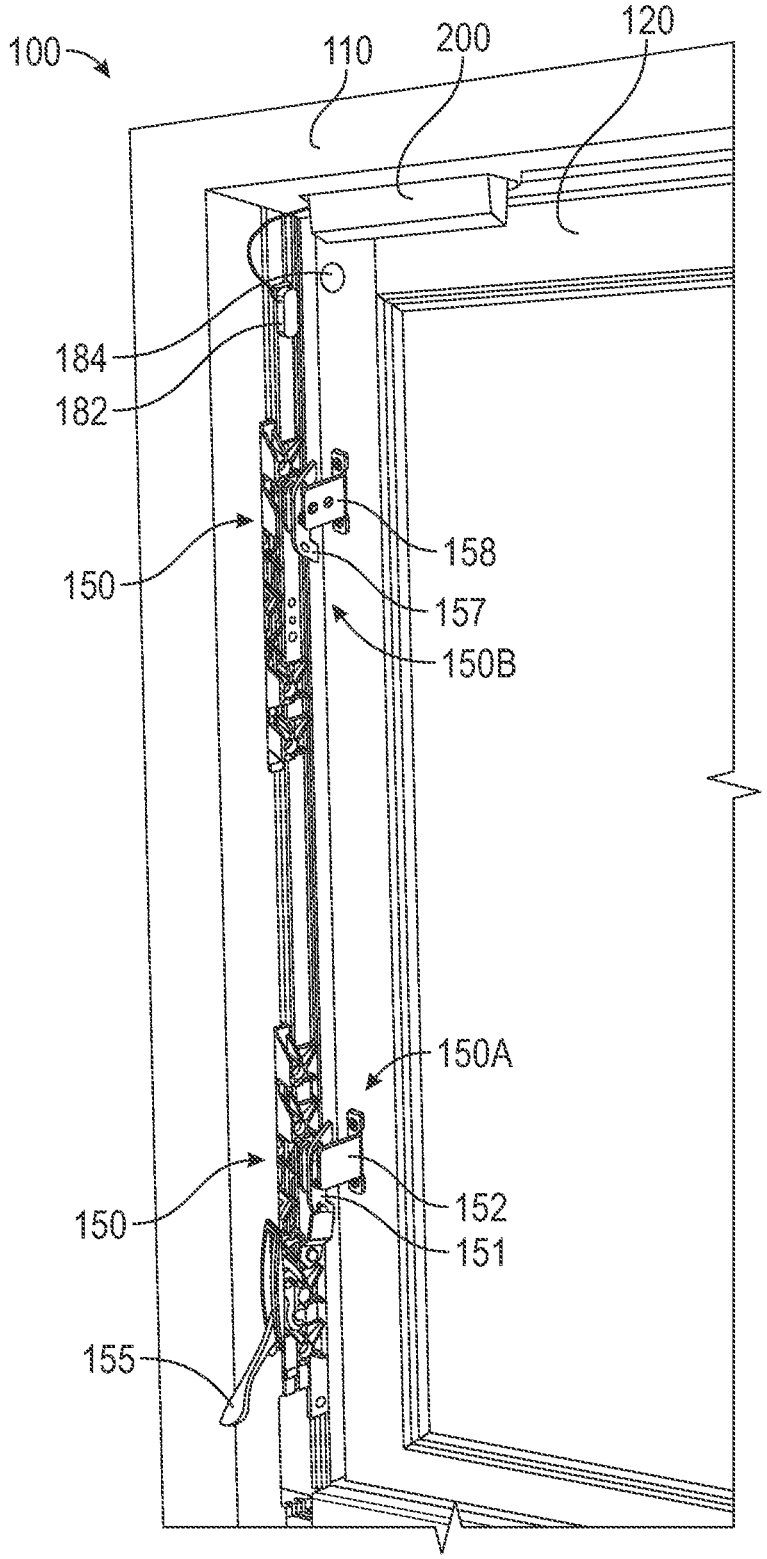
FIG. 3D is a detailed perspective view showing the fenestration assembly of FIG. 1 in a third unsecure configuration with the panel in the open position and the locking mechanism is in the locked configuration, and the locking mechanism blocks further closing of the panel.

FIG. 3D is a detailed perspective view showing the fenestration assembly 100 of FIG. 1 in a third unsecure configuration with the panel 120 in the open position and the locking mechanism is in the locked configuration, and the locking mechanism 150 blocks further closing of the panel 120. In some examples, the locking mechanism 150 includes a blocking configuration, and the locking mechanism 150 prevents the positioning of the panel 120 in the closed position. In the example shown in FIG. 3D, the first latch 151 is not coupled with the first latch fastener 152. Instead, the first latch fastener 152 is engaged with first latch 151, and the engagement of the first latch fastener 152 with the first latch 151 prevents the positioning of the panel 120 in the closed position.

For example, the locking mechanism 150 is in the locking configuration, the first latch 151 is aligned with the first latch fastener 152, and the first latch 151 intercepts the first latch fastener 152 with movement (e.g., rotation) of the panel 120 toward the closed position. The first latch 151 prevents positioning of the panel 120 in the closed position. Accordingly, the sensor operator 184 is remote relative to the sensor 182 because the first latch 151 is intercepting the first latch fastener 152 and the status monitoring assembly 100 reports an unsecure configuration of the fenestration assembly 100, including (but not limited to) the third unsecure configuration shown in FIG. 3D.

Figure 4:
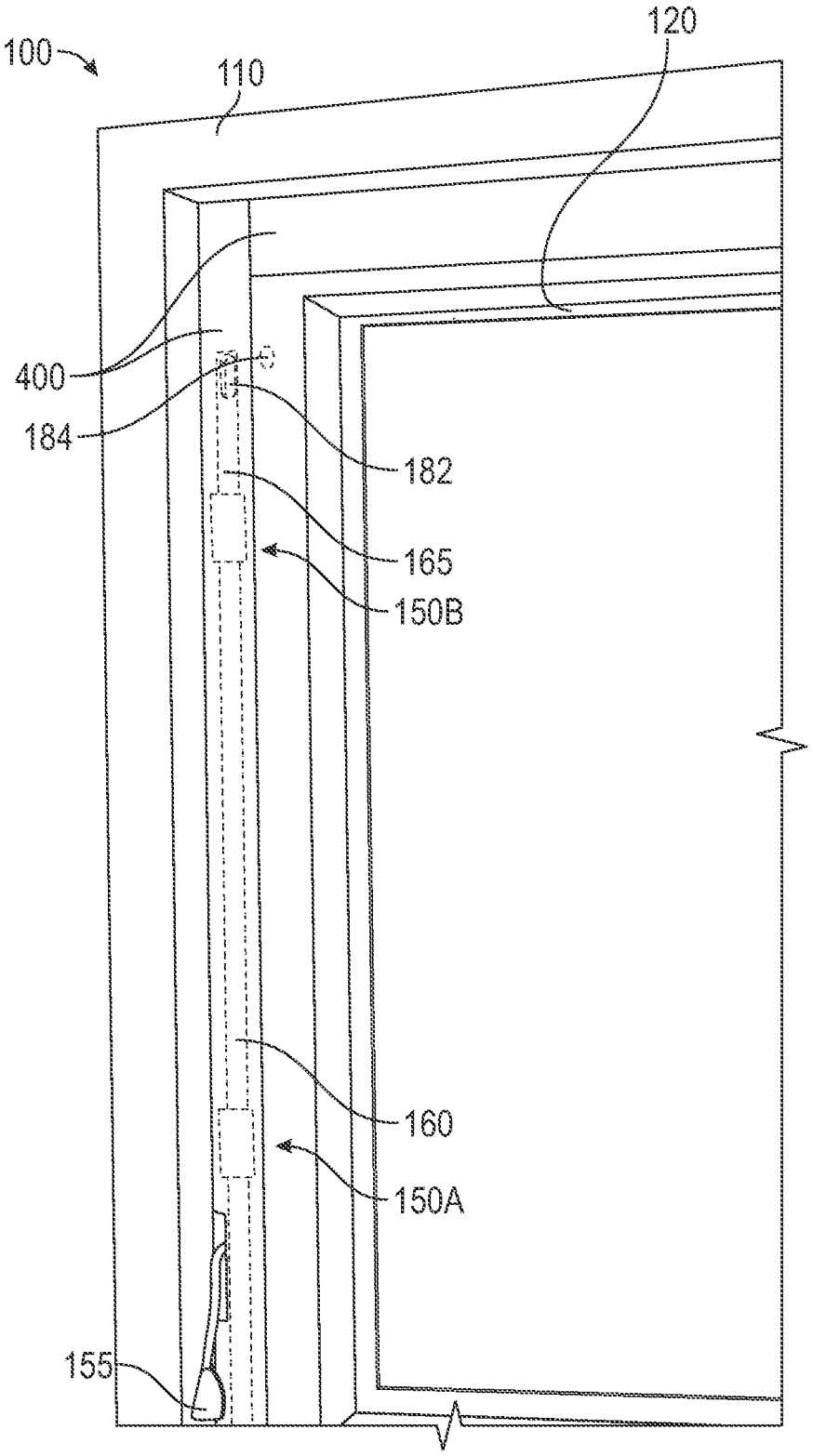
FIG. 4 is a perspective view of the fenestration assembly of FIG. 1 with an example mechanism and monitoring cover coupled with the assembly.

FIG. 4 is a perspective view of the fenestration assembly 100 of FIG. 1 with mechanism and monitoring cover 400 coupled with the assembly 100. The mechanism and monitoring cover 400 is a concealing facie that is coupled to the fenestration assembly 100 to, among other things, improve the aesthetic appeal of the fenestration assembly 100. The mechanism and monitoring cover 300 conceals (e.g., hides, obscures, or the like) components of the locking mechanism 150 and the status monitoring assembly 180, including (but not limited to) the first locking mechanism 150A, the second locking mechanism 150B, the tie bar 160, the tie bar arm 165, the sensor 182, the sensor operator 184, and the module 200.

In some examples, the mechanism and monitoring cover 400 defines a recess to allow the locking operator 155 to be moved (e.g., manipulated by a user) while the remaining components of the locking mechanism 150 are concealed by the mechanism and monitoring cover 400. Optionally, the mechanism and monitoring cover 400 matches the finish of the remainder of the fenestration assembly 100 (e.g., wood grain, paint, vinyl, another polymer, or the like).

Figure 5:
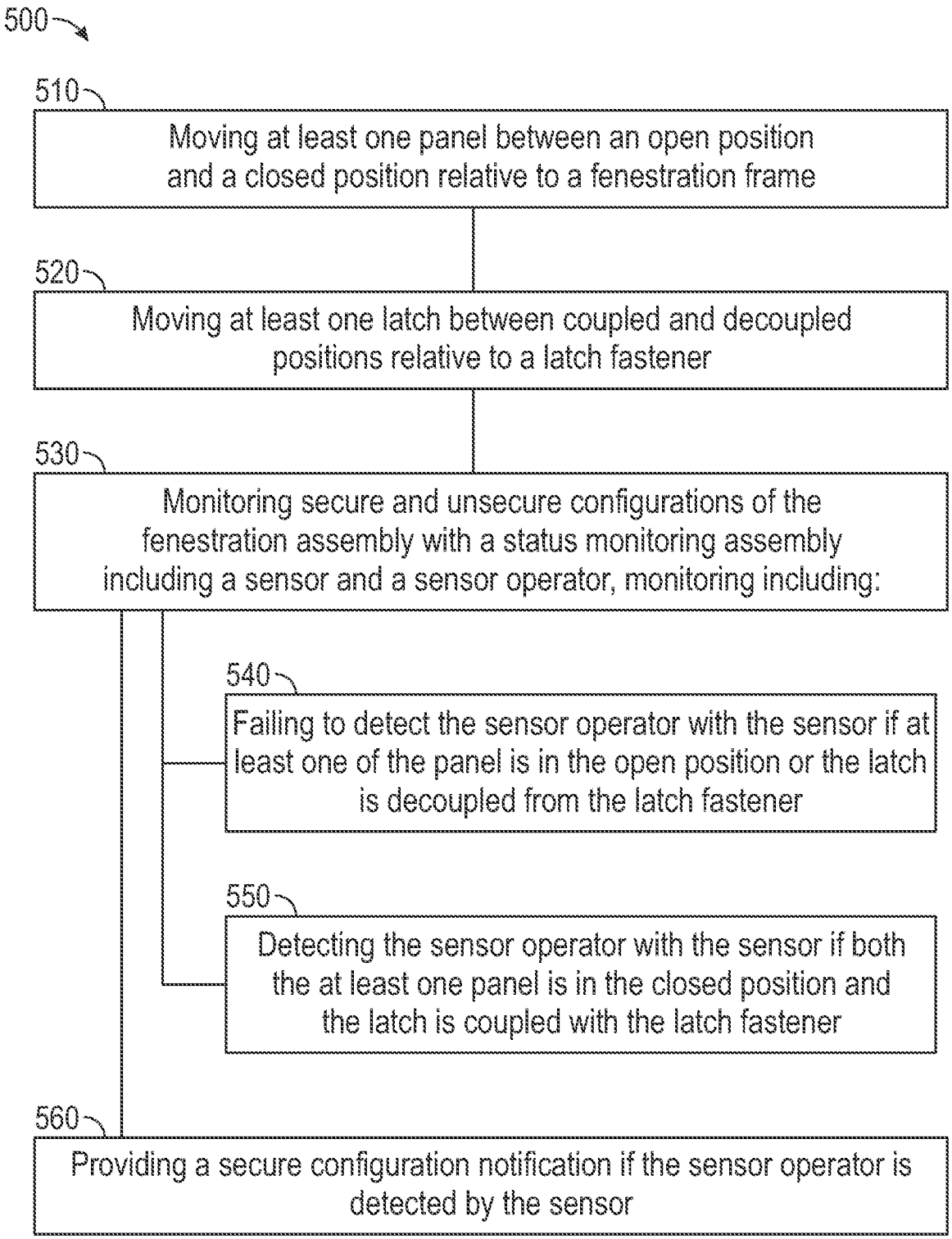
FIG. 5 is a block diagram showing one example of a method for monitoring the status of a fenestration assembly.

FIG. 5 is a block diagram showing one example of a method 500 for monitoring a status of a fenestration assembly 100. In describing the method 500, reference is made to one or more components, features, functions and operations previously described herein. Where convenient, reference is made to the components, features, operations and the like with reference numerals. The reference numerals provided are exemplary and are not exclusive. For instance, components, features, functions, operations and the like described in the method 500 include, but are not limited to, the corresponding numbered elements provided herein and other corresponding elements described herein (both numbered and unnumbered) as well as their equivalents.

At 502, at least one panel 120 is moved between an open position and a closed position relative to a fenestration frame 110 (see FIGS. 3A-3B). For instance, the panel 120 is rotated relative to the fenestration frame 110. At 504, the method 500 includes moving at least one latch (e.g., the first latch 151 and/or the second latch 157, shown in FIG. 1) between coupled and decoupled positions relative to a latch fastener, for instance the first latch fastener 152 or the second latch fastener 158. For example, an operator (e.g., the locking operator 155 of FIGS. 3A-3D) is moved. The movement of the operator is transmitted to the at least one latch, including (but not limited to) transmitting the motion with a tie bar 160. As described herein, the at least one latch moves according to (e.g., corresponding with) the movement of the operator.

At 506, the secure and unsecure configurations of the fenestration assembly 100 are monitored with a status monitoring assembly 180 including a sensor 182 and a sensor operator 184. The sensor 182 detects the sensor operator 184, and optionally transmits a signal (or no signal) to facilitate the reporting of the secure and unsecure configurations of the fenestration assembly 100.

At 508, monitoring the configuration of the fenestration assembly 100 includes failing to detect the sensor operator 184 with the sensor 182 if at least one of the panel 120 is in the open position or the latch (e.g., the first latch 151, shown in FIG. 2) is decoupled from the latch fastener (e.g., the first latch fastener 152, shown in FIG. 2).

At 510, monitoring the configuration of the fenestration assembly 100 includes detecting the sensor operator 184 with the sensor 182 if both the at least one panel 120 is in the closed position and the latch (e.g., the second latch 157, shown in FIG. 1) is coupled with the latch fastener (e.g., the second latch fastener 158, shown in FIG. 1). For example, the sensor 182 is coupled with the tie bar 160, the sensor 182 moves with the tie bar 160. The sensor 182 is moved into proximity with the sensor operator 184, and the sensor 182 detects the sensor operator 184. In another example, the sensor 182 is moved into proximity with the sensor operator 184, and the sensor 182 is moved away from the latch fastener (e.g., the second latch fastener 158).

In yet another example, the sensor operator 184 is detected by moving the at least one panel 120 into the closed position. The sensor operator 184 is moved into proximity with the sensor 182 with movement of the at least one panel 200. Optionally, the sensor 182 is moved into proximity with the sensor operator 184 with movement of the at least one latch (e.g., the first latch 151). For instance, the sensor 182 is coupled with the tie bar 160, the tie bar 160 is configured to move the at least one latch, and the sensor 182 is moved with the tie bar 160 and the at least one latch.

At 512, a secure configuration notification is provided if the sensor operator 184 is detected by the sensor 182. For example, the module 200 is in communication with the sensor 182 (e.g., hard-wired or wirelessly), and the module 200 provides the secure notification to a user, including (but not limited to) an electronic device (e.g., a cellular phone, a tablet computer, a desktop computer, a home automation display, or the like).

Various Notes & Examples

Example 1 can include subject matter, such as a fenestration assembly configured for status monitoring, the fenestration assembly comprising: a fenestration frame; at least one panel rotatably coupled with the fenestration frame between open and closed positions; a locking mechanism coupled with the fenestration frame and the panel, the locking mechanism includes at least one latch and at least one latch fastener, one of the latch or latch fastener is coupled with the fenestration frame and the other of the latch fastener or latch is coupled with the panel; wherein the fenestration assembly includes secure and unsecure configurations, in the secure configuration the panel is in the closed position and the latch is coupled with the latch fastener, and in the unsecure configuration one or more of the panel is in the open position or the latch is decoupled from the latch fastener; and a status monitoring assembly configured to monitor secure and unsecure configurations of the fenestration assembly, the status monitoring assembly includes: a sensor operator coupled with one of the fenestration frame or the panel, and a sensor coupled with the other of the panel or the fenestration frame, and the sensor is configured to detect the sensor operator if the panel is in the closed position and the latch is coupled with the latch fastener.

Example 2 can include, or can optionally be combined with the subject matter of Example 1, to optionally include wherein the status monitoring assembly is configured to report the secure configuration with the sensor operator detected by the sensor, and the status monitoring assembly is configured to report the unsecure configuration with the sensor operator undetected by the sensor.

Example 3 can include, or can optionally be combined with the subject matter of one or any combination of Examples 1 or 2 to optionally include wherein the latch includes a latch blade having a tapered portion and a locking portion, the tapered portion is configured to bias the latch fastener toward the locking portion. Example 4 can include, or can optionally be combined with the subject matter of one or any combination of Examples 1-3 to optionally include wherein the sensor is configured to detect the sensor operator only if the panel is in the closed position and the latch is coupled with the latch fastener.

Example 5 can include, or can optionally be combined with the subject matter of one or any combination of Examples 1~4 to optionally include wherein the sensor operator is selected from the group consisting of a magnet, a mechanical contact or an electrical contact and the sensor is selected from the group consisting of a magnetic sensor, a mechanical switch or an electrical switch.

Example 6 can include, or can optionally be combined with the subject matter of Examples 1-5 to optionally include wherein the locking mechanism includes: an operator, a tie bar coupled between the operator and the latch, and wherein movement of the operator between locked and unlocked positions moves the tie bar and the latch between corresponding locked and unlocked positions.

Example 7 can include, or can optionally be combined with the subject matter of Examples 1-6 to optionally include wherein each of the operator, tie bar and the latch are coupled with the fenestration frame, and the latch fastener is coupled with the panel.

Example 8 can include, or can optionally be combined with the subject matter of Examples 1-7 to optionally include wherein the sensor is coupled with the tie bar, and the sensor operator is coupled with the panel.

Example 9 can include, or can optionally be combined with the subject matter of Examples 1-8 to optionally include wherein the sensor is remote relative to the latch fastener with the latch in a locked position, and the sensor is more proximate to the latch fastener in an unlocked position than in the locked position. Example 10 can include, or can optionally be combined with the subject matter of Examples 1-9 to optionally include wherein the sensor operator is remote relative to the latch fastener and the latch.

Example 11 can include, or can optionally be combined with the subject matter of Examples 1-10 to optionally include a fenestration assembly configured for status monitoring, the fenestration assembly comprising: a fenestration frame; at least one panel rotatably coupled with the fenestration frame between open and closed positions; a locking mechanism coupled with the fenestration frame and the panel, the locking mechanism includes: at least one latch fastener, at least one latch, an operator, a tie bar coupled between the operator and the latch, and wherein movement of the operator between locked and unlocked positions moves the tie bar and the latch between corresponding locked and unlocked positions; and a status monitoring assembly configured to monitor secure and unsecure configurations of the fenestration assembly, the status monitoring assembly includes: a sensor operator coupled with one of the fenestration frame or the panel, and a sensor coupled with the other of the panel or the fenestration frame, and the sensor is configured to detect the sensor operator if the sash is in the closed position and the latch is coupled with the latch fastener in the locked configuration.

Example 12 can include, or can optionally be combined with the subject matter of Examples 1-11 to optionally include wherein each of the operator, tie bar and the latch are coupled with the fenestration frame, and the latch fastener is coupled with the panel.

Example 13 can include, or can optionally be combined with the subject matter of Examples 1-12 to optionally include wherein the sensor is coupled with the tie bar, and the sensor operator is coupled with the panel.

Example 14 can include, or can optionally be combined with the subject matter of Examples 1-13 to optionally include wherein the sensor is remote relative to the latch fastener with the latch in the locked position, and the sensor is more proximate to the latch fastener in the unlocked position than in the locked position.

Example 15 can include, or can optionally be combined with the subject matter of Examples 1-14 to optionally include wherein the sensor operator is remote relative to the latch fastener and the latch.

Example 16 can include, or can optionally be combined with the subject matter of Examples 1-15 to optionally include wherein the at least one latch includes first and second latches, and the tie bar couples each of the first and second latches with the operator.

Example 17 can include, or can optionally be combined with the subject matter of Examples 1-16 to optionally include wherein the locking mechanism includes a blocking configuration, and in the blocking configuration with the panel in the open position and the latch in the locked position the latch is aligned with the latch fastener, the latch intercepts the latch fastener with movement of the panel toward the closed position and prevents positioning of the panel in the closed position, and the sensor operator is held remote from the sensor with the latch intercepting the latch fastener.

Example 18 can include, or can optionally be combined with the subject matter of Examples 1-17 to optionally include wherein the status monitoring assembly is configured to report a secure configuration with the sensor operator detected by the sensor, and the status monitoring assembly is configured to report an unsecure configuration with the sensor operator undetected by the sensor.

Example 19 can include, or can optionally be combined with the subject matter of Examples 1-18 to optionally include wherein the latch fastener includes a pin, and the latch includes a latch blade having a tapered portion and a locking portion, the tapered portion is configured to bias the pin toward the locking portion.

Example 20 can include, or can optionally be combined with the subject matter of Examples 1-19 to optionally include wherein the sensor is configured to detect the sensor operator only if the sash is in the closed position and the latch is in the locked position.

Example 21 can include, or can optionally be combined with the subject matter of Examples 1-20 to optionally include wherein the sensor operator includes one or more of a magnet, a mechanical contact or an electrical contact, and the sensor includes one or more of a magnetic sensor, a mechanical switch or an electrical switch.

Example 22 can include, or can optionally be combined with the subject matter of Examples 1-21 to optionally include a power source in electrical communication with the sensor, and the power source is concealed within one or more of the panel or the fenestration frame.

Example 23 can include, or can optionally be combined with the subject matter of Examples 1-22 to optionally include a transceiver in electrical communication with the sensor, and the transceiver is concealed within one or more of the panel or the fenestration frame.

Example 24 can include, or can optionally be combined with the subject matter of Examples 1-23 to optionally include a method for monitoring a status of a fenestration assembly comprising: moving at least one panel between an open position and a closed position relative to a fenestration frame; moving at least one latch between coupled and decoupled positions relative to a latch fastener; monitoring secure and unsecure configurations of the fenestration assembly with a status monitoring assembly including a sensor and a sensor operator, monitoring including: failing to detect the sensor operator with the sensor if at least one of the panel is in the open position or the latch is decoupled from the latch fastener, and detecting the sensor operator with the sensor if both the at least one panel is in the closed position and the latch is coupled with the latch fastener; and providing a secure configuration notification if the sensor operator is detected by the sensor.

Example 25 can include, or can optionally be combined with the subject matter of Examples 1-24 to optionally include wherein moving the at least one panel includes rotating the at least one panel relative to the fenestration frame. Example 26 can include, or can optionally be combined with the subject matter of Examples 1-25 to optionally include wherein moving the at least one latch between coupled and decoupled positions includes: moving an operator, transmitting movement from the operator to the at least one latch with a tie bar, and moving the at least one latch according to movement of the operator.

Example 27 can include, or can optionally be combined with the subject matter of Examples 1-26 to optionally include wherein detecting the sensor operator with the sensor includes moving the sensor into proximity with the sensor operator, the sensor is coupled with the tie bar and moves with the tie bar.

Example 28 can include, or can optionally be combined with the subject matter of Examples 1-27 to optionally include wherein detecting the sensor operator with the sensor includes: moving the at least one panel into the closed position and moving the sensor operator into proximity with the sensor with movement of the at least one panel, and moving the sensor into proximity with the sensor operator with movement of the at least one latch.

Example 29 can include, or can optionally be combined with the subject matter of Examples 1-28 to optionally include wherein moving the sensor into proximity with the sensor operator with movement of the least one latch includes moving the sensor with a tie bar configured to move the at least one latch, the sensor coupled with the tie bar.

Example 30 can include, or can optionally be combined with the subject matter of Examples 1-29 to optionally include wherein detecting the sensor operator with the sensor includes: moving the sensor into proximity with the sensor operator, and moving the sensor away from the latch fastener.

Each of these non-limiting examples can stand on its own, or can be combined in various permutations or combinations with one or more of the other examples.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A status monitoring system for a fenestration assembly, the status monitoring system comprising:

a sensor operator configured for coupling with one of a fenestration frame or a panel of the fenestration assembly, wherein the panel is moveable relative to the fenestration frame;

a sensor configured for coupling with the other of the panel or the fenestration frame of the fenestration assembly, wherein the sensor is configured to detect the sensor operator; and a fenestration status controller configured for communication with the sensor and the sensor operator, wherein the fenestration status controller determines secure and unsecure configurations for the fenestration assembly:

the controller is configured to determine the fenestration assembly is in the secure configuration with the sensor operator proximate to the sensor while the panel is closed and latched, and the controller is configured to determine the fenestration assembly is in the secure configuration while the sensor operator is detected by the sensor in each of the closed and latched positions; and the controller is configured to determine the fenestration assembly is in the unsecure configuration with the sensor operator remote to the sensor while the panel is open or unlatched.

2. The fenestration assembly of claim 1, wherein the fenestration status controller is configured to determine the secure configuration with the sensor operator detected by the sensor, and the fenestration status controller is configured to report the unsecure configuration with the sensor operator undetected by the sensor.

3. The fenestration assembly of claim 1, wherein:

the sensor operator includes one or more of a magnet, a mechanical contact, or an electrical contact; and the sensor includes one or more of a magnetic sensor, a mechanical switch, or an electrical switch.

4. The status monitoring system of claim 1, further comprising a locking mechanism including a latch and a latch fastener wherein:

one of the latch or latch fastener is configured for coupling with the fenestration frame and the other of the latch fastener or latch is configured for coupling with the panel; and the latch fastener is configured to selectively couple with the latch to lock the panel in a closed position.

5. The status monitoring system of claim 4, wherein the locking mechanism includes one or more of the sensor or the sensor operator.

6. The status monitoring system of claim 4, wherein the sensor is remote from the sensor operator with the latch fastener decoupled from latch.

7. The fenestration assembly of claim 1, further comprising a power source in electrical communication with the sensor, and the power source is configured for coupling with one or more of the panel or the fenestration frame.

8. The fenestration assembly of claim 1, wherein the controller is configured to determine the fenestration assembly is in the unsecure configuration including the sensor failing to detect the sensor operator with one or more of the panel open or the panel unlatched.

9. The status monitoring system of claim 1 comprising the fenestration assembly having the fenestration frame and the panel.

10. The status monitoring system of claim 9, wherein the panel is rotatably coupled with the fenestration frame.

11. The status monitoring system of claim 9, wherein the panel is configured to move with respect to the fenestration frame between open and closed positions.

12. A fenestration assembly configured for status monitoring, the fenestration assembly comprising:

a latch fastener configured for coupling with one of a fenestration frame or a panel of the fenestration assembly;

a latch configured for coupling with the other of the panel or the fenestration frame, wherein the panel is moveable relative to the frame; and a status monitoring assembly, including:

a sensor operator configured for coupling with one of the fenestration frame or the panel;

a sensor configured for coupling with the other of the panel or the fenestration frame, wherein the sensor is configured to detect the sensor operator; and a fenestration status controller in communication with the sensor, wherein the fenestration status controller is configured to determine secure and unsecure configurations for the fenestration assembly:

the controller is configured to determine the fenestration assembly is in the secure configuration with the sensor operator proximate to the sensor while the panel is closed and latched, and the controller is configured to determine the fenestration assembly is in the secure configuration while the sensor operator is detected by the sensor in each of the closed and latched positions; and the controller is configured to determine the fenestration assembly is in the unsecure configuration with the sensor operator remote to the sensor while the panel is open or unlatched.

13. The fenestration assembly of claim 12, further comprising a locking mechanism configured for coupling with a fenestration frame and a panel, the locking mechanism including:

the latch fastener;

the latch;

an operator;

a tie bar coupled between the operator and the latch; and wherein movement of the operator between locked and unlocked positions moves the tie bar and the latch between corresponding locked and unlocked positions.

14. The fenestration assembly of claim 13, wherein each of the operator, tie bar and the latch are configured for coupling with the fenestration frame, and the latch fastener is configured for coupling with the panel.

15. The fenestration assembly of claim 14, wherein the sensor is configured for coupling with the tie bar, and the sensor operator is configured for coupling with the panel.

16. The fenestration assembly of claim 12, wherein the sensor is remote relative to the latch fastener with the latch in a locked position, and the sensor is more proximate to the latch fastener in an unlocked position than in the locked position.

17. The fenestration assembly of claim 16, wherein the sensor operator is remote relative to the latch fastener and the latch.

18. The fenestration assembly of claim 12, comprising the fenestration assembly having the fenestration frame and the panel.

19. The fenestration assembly of claim 12, wherein the controller is configured to determine the fenestration assembly is in the unsecure configuration including the sensor failing to detect the sensor operator with one or more of the panel open or the panel unlatched.

20. A method for monitoring a status of a fenestration assembly including a fenestration frame and a panel moveable relative to the fenestration frame between open and closed positions, the method comprising:

monitoring secure and unsecure configurations of the fenestration assembly with a status monitoring assembly including a sensor and a sensor operator, monitoring including:

failing to detect the sensor operator with the sensor while the panel is open or unlatched;

detecting the sensor operator with the sensor while the panel is in the closed position and the latch is coupled with the latch fastener; and determining the fenestration assembly is in the secure configuration with the sensor detecting the sensor operator in each of the closed and latched positions.

21. The method of claim 20, wherein monitoring secure and unsecure configurations includes:

determining the fenestration assembly is in the unsecure configuration with the sensor failing to detect the sensor operator.

22. The method of claim 20, further comprising:

moving at least one panel between an open position and a closed position relative to a fenestration frame, wherein the fenestration frame surrounds the panel.

23. The method of claim 20, further comprising:

moving at least one latch between coupled and decoupled positions relative to the latch fastener.

24. The method of claim 23, wherein moving the at least one latch between coupled and decoupled positions includes:

moving an operator;

transmitting movement from the operator to the at least one latch with a tie bar; and moving the at least one latch according to movement of the operator.

25. The method of claim 24, wherein detecting the sensor operator with the sensor includes moving the sensor into proximity with the sensor operator, the sensor is coupled with the tie bar and moves with the tie bar.

26. The method of claim 20, wherein detecting the sensor operator with the sensor includes:

moving the sensor into proximity with the sensor operator; and moving the sensor away from the latch fastener.

* * * * *